US006262698B1

(12) United States Patent
Blum

(10) Patent No.: US 6,262,698 B1
(45) Date of Patent: Jul. 17, 2001

(54) METHOD AND APPARATUS FOR DISPLAY SIGN

(76) Inventor: Dieter W. Blum, 5115 - 244th Street, Langley, British Columbia (CA)

( * ) Notice: Subject to any disclaimer, the term of this patent is extended or adjusted under 35 U.S.C. 154(b) by 0 days.

(21) Appl. No.: 09/020,090

(22) Filed: Feb. 6, 1998

Related U.S. Application Data

(60) Provisional application No. 60/037,447, filed on Feb. 6, 1997.

(51) Int. Cl.[7] ..... G09G 3/20

(52) U.S. Cl. ..... 345/55; 345/1; 345/46; 345/56

(58) Field of Search ..... 345/55, 56, 57, 345/46, 47, 73, 1–2, 109, 108, 4, 6, 82–83; 40/447, 463, 449; 362/345

(56) References Cited

U.S. PATENT DOCUMENTS

| | | | | |
|---|---|---|---|---|
| 640,153 | | 12/1899 | Yaxley et al. . | |
| 1,765,215 | | 6/1930 | Duchard . | |
| 2,154,110 | * | 4/1939 | Parks | 40/463 |
| 3,250,031 | * | 5/1966 | Bowman | 40/447 |
| 3,631,461 | * | 12/1971 | Powell et al. | 345/73 |
| 4,761,905 | * | 8/1988 | Black | 40/447 |
| 4,983,956 | * | 1/1991 | Salam | 345/109 |
| 5,132,695 | * | 7/1992 | Dabbaj | 345/108 |
| 5,184,116 | * | 2/1993 | Daugherty et al. | 345/109 |
| 5,712,650 | * | 1/1998 | Barlow | 345/55 |

FOREIGN PATENT DOCUMENTS

| | | |
|---|---|---|
| 352796 | 7/1928 | (BE) . |
| WO97/25701 | 7/1997 | (WO) . |

* cited by examiner

*Primary Examiner*—Richard Hjerpe
*Assistant Examiner*—Frances Nguyen
(74) *Attorney, Agent, or Firm*—Robert B. Hughes; Hughes & Schacht, PLLC

(57) ABSTRACT

A matrix display sign and system where the displayed image or message can readily be changed. There is an array of pixel units arranged in rows and columns, and each of these pixel units can be selectively activated to display various selected colors. In a preferred embodiment, each pixel unit is capable of displaying any of a blue, green, red, white or black color. Each pixel unit has an elongate strip member having pixel sections, each having a different color characteristic. The pixel strip is moved in increments so that various pixel sections can be moved into a display region where either reflective light or transflective light illuminates the pixel section. A solenoid driver is activated to move in stepped increments to move the pixel strip to selected positions at the display region.

16 Claims, 8 Drawing Sheets

METHOD AND APPARATUS FOR DISPLAY SIGN

This application claims benefit of Provisional Appln. 60/037,447 filed Feb. 6, 1997.

BACKGROUND OF THE INVENTION a) Field of the Invention

The present invention relates to an apparatus and method for display signs where the image or message can be easily and rapidly displayed, and readily changed to some other image or message. More particularly, the present invention relates to such a display sign which is capable of providing multiple color displays.

b) Background Art

For many decades, there have been various matrix display signs made up of display elements, pixels or the like which are selectively activated to display a picture or a message. In its simplest form, such a display sign comprises an array of incandescent lamps, each of which can selectively be turned on or off. However, as these signs become quite large, the expense and the practical problems increase substantially.

If the sign is as large as 4×8 feet, or even 10×20 feet, the individual picture elements (or pixels) can be arranged in as many as several hundred to a thousand or more columns and possibly as many rows. Then there are considerations of providing a practical control and actuating system which is sufficiently versatile to meet the practical requirements of operating effectively to display different pictures or messages. Further, there are considerations of reliability, and the level of maintenance required.

Then there are the considerations which might be termed the "aesthetics" of the display sign. Desirably the individual elements are so arranged that the character of the picture has precision and is visually attractive. Normally, this would require that the individual picture elements are positioned so as to minimize any "gaps" (spaces between the illuminating portions of the display elements).

One of the more significant challenges has been to provide display signs which are multi-colored. The technology of colored TV is, as a practical matter, not readily adapted to a very large display sign.

A search of the patent literature has disclosed a number of U.S. patents relating to display signs in general. These are as follows:

U.S. Pat. No. 2,154,110 (Parks) discloses an illuminated type display device for billboard advertising, etc. There is a plurality of light tubes 13 positioned parallel and closely adjacent to one another, and arranged to be in the same plane. These are arranged in three groups each, with the tubes in each group of three having a different gas therein or otherwise arranged, so that these adjacent tubes in each group are green, red and blue. There are possibly two hundred to nine hundred such tubes.

There is a plurality of solenoid operated flexible resilient plates positioned along the length of each tube, as shown in FIGS. 7 and 8. In FIG. 7, the resilient plate is a resilient strip which wraps 180° around one portion of one tube. The strip is attached to a solenoid which is spring loaded to its out position where the element would be covering the light. When the solenoid is activated against the urging of the spring, the masking element is withdrawn, as shown in the lower part of FIG. 7, to let that portion of the tube shine through. Thus, by selectively operating various solenoids, different pixels will show up, some red, some green, and some blue, to form a composite picture.

The solenoids are controlled from a switch board, where there are a plurality of switch elements, some of which are connected to raised portions of a conducting plate, which is in turn connected to a battery. The raised portions are in contact with selected switches, and the recessed portions are out of contact. This middle conducting board is made by an etching process. The plate has a sensitized plate or film placed thereon, and this in turn is covered by a color filter which has a plurality of colored strips, and arranged in the same red, green and blue pattern as the tubes which are illuminated. The picture or graphics to be represented on the sign is photographed as a negative against the screen, and thus the image to be photographed appears on the sensitized film, where certain unexposed areas correspond to locations of the red, green and blue locations. Then the plate is put to an etching process to create the recess. To display the picture, the plate is then placed against the switch board, as shown in FIG. 1, thus making contact with the appropriate switches, which in turn retract the masking elements.

Another arrangement of the solenoid is shown in FIG. 9, where the masking member has a hinge element. Yet another arrangement is shown in FIG. 10 where the masking strip extends from a spring around a U shaped housing at a portion of the light tube, with the other end of the masking member connecting to a solenoid element.

Another method of creating this display is shown in FIGS. 13 and 14. This has the same sort of masking elements, which are solenoid operated, but the control board is composed of a plurality of photoelectric cells, one for each mask. The image is projected by a projector against the control board and thus, the image projected against the photoelectric cells to activate the appropriate solenoids to withdraw the related masks to form the image.

U.S. Pat. No. 5,132,675 (Dabbaj) discloses a system for display signs where there are individual pixel elements. Each pixel element has a set of different colored vanes which appear to be in the form of flat plates which are moved outwardly by electromagnetic means to different locations displaying different colored areas across the vanes to get different color mixes. Six distinct mixes can be obtained by using three vanes per set.

U.S. Pat. No. 3,250,031 (Bowman) shows a display unit for score boards where there are a plurality of window sets, each displaying a number. As can be seen in FIG. 1, there is an array of approximately twenty window segments, each having a retractable display portion which can be retracted by a solenoid. By placing the appropriate display elements together, all of the ten numerals can be displayed.

U.S. Pat. No. 640,153 (Yaxley) shows a solenoid that moves an optical element in a signaling device.

SUMMARY OF THE INVENTION

The present invention provides an effective and practical apparatus and method for a matrix display, which is particularly adapted for the display of multi-colored images which can readily and conveniently be changed to display various images, pictures, messages, and the like.

The invention comprises a display apparatus comprising a mounting structure providing a display area. There is a plurality of display elements positioned at respective spaced locations along the display area. Each of the display elements has a display region at a respective display location in the display area.

Each of the display elements comprises a color responsive pixel member having a set of color responsive pixel sections. Each of the pixel sections has a color character differing from the color character of other of said color responsive pixel sections of that set.

There is actuating means to selectively move the pixel members to position selected ones of the pixel sections at their respective display regions. Thus, a multi-colored image can be displayed by displaying various pixel sections of different color character in an appropriate pattern corresponding to the image to be displayed.

In some embodiments the pixel sections are reflective and light traveling toward the display area is reflected from the pixel sections at their respective display regions. In other embodiments the pixel sections are transflective, and there is light means directed toward said pixel sections at the display region from a location behind the display area.

In the preferred form, the color responsive pixel member comprises a pixel strip, with the pixel sections being positioned at spaced locations along the strip. The actuating means the pixel strip through increments of travel to positioned selected ones of the pixel sections at the display location.

In a preferred form, each display element has a forward to rear axis having a substantial alignment component perpendicular to the display area. The pixel strip is positioned to travel a linear component of travel forward to the display region, over the display region, and then rearwardly from the display region, and also in a reverse direction. Thus, the pixel member, moving along a linear path of travel, is able to have selected pixel sections positioned at the display region.

The pixel strip is sufficiently flexible to travel along the travel path, but sufficiently stiff so that the pixel strip can be either pushed or pulled as they move along the travel path.

In a preferred form, the actuating means comprises a plurality of actuators, with each of the display elements having a respective one of the actuators. Each of the actuators is arranged to be able to be moved through increments of travel corresponding to spacing of the pixel sections. Thus, each of the actuators in moving sequentially to various actuating positions is able to move the pixel strip to appropriate locations to display a selected one of the pixel sections at the display region.

In a preferred form, each of the actuators is a solenoid actuator, having an armature, and the armature is arranged to be moved linearly to selected locations. Specifically, each of the solenoid actuators has a plurality of coil sections spaced from one another, and selected coil sections are able to be activated to create magnetic fields to position said solenoid at selected locations.

In the specific embodiments shown herein, the display elements are arranged in columns and rows. The apparatus further comprises a control system comprising a plurality of column drivers, each operatively connected to a respective column, and a plurality of row drivers, each operatively connected to a respective row. The control means has the capability of activating selected ones of said column drivers and row drives in a timely manner that display elements aligned with any pair of an activated column driver and an activated row driver is activated.

In a preferred form, at least one of the row driver or column drivers has a plurality of switch means operatively connected to related coil sections so as to selectively activate one or more of the coil sections of that related display element to position a selected pixel segment at said display area.

In the method of the present invention, a display apparatus is provided as described above. The method comprises moving the pixel members to positions selected ones of the pixel sections at their respective display regions. Thus, there is accomplish the multi-color image as described above.

It is believed that other aspects of the method of the present invention are readily understood from the above text, and also the following text describing the present invention more specifically.

Various other features of the present invention will become apparent from the following detailed description.

DESCRIPTION OF THE PREFERRED EMBODIMENTS

It is believed a clearer understanding of the present invention will be obtained by first providing a brief description of three of the common prior art matrix display systems, after which there will be a more detailed description of the present invention.

(a) Prior Art Matrix Display Systems

Figure 1:
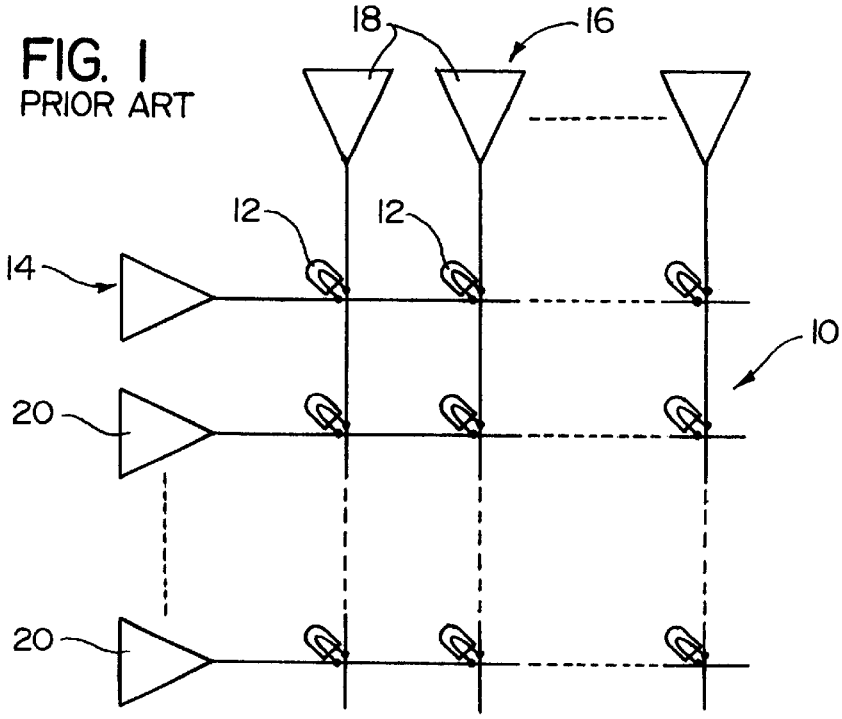
FIG. 1 PRIOR ART
FIG. 1 is a schematic drawing of one type of a prior art matrix display system using incandescent bulbs.

Reference is first made to FIG. 1 which shows somewhat schematically a prior art display sign 10, where there is a plurality of incandescent bulbs 12 arranged in horizontal rows 14 and vertical columns 16. There is a plurality of column drivers 18 and a plurality of row drivers 20.

Each of the bulbs 20 is selectively turned on by activating selected drivers 18 and 20. This could be controlled by multiplex means, wherein the row and column drivers are scanned so as to effect the illumination of any desired bulb in the matrix. If this is performed at a rate that is high enough, display flicker will be unnoticeable. The advantage of multiplexed drive is a large reduction in the complexity and the cost of the drive electronics, and the disadvantage is the reduction in bulb brightness, due to the column or row duty cycle factor. This is usually offset in practice by increasing bulb drive current (overdriving), but this in turn brings on thermal shock and filament stress problems in bulbs, which lead to increased failure rates.

Figure 2:
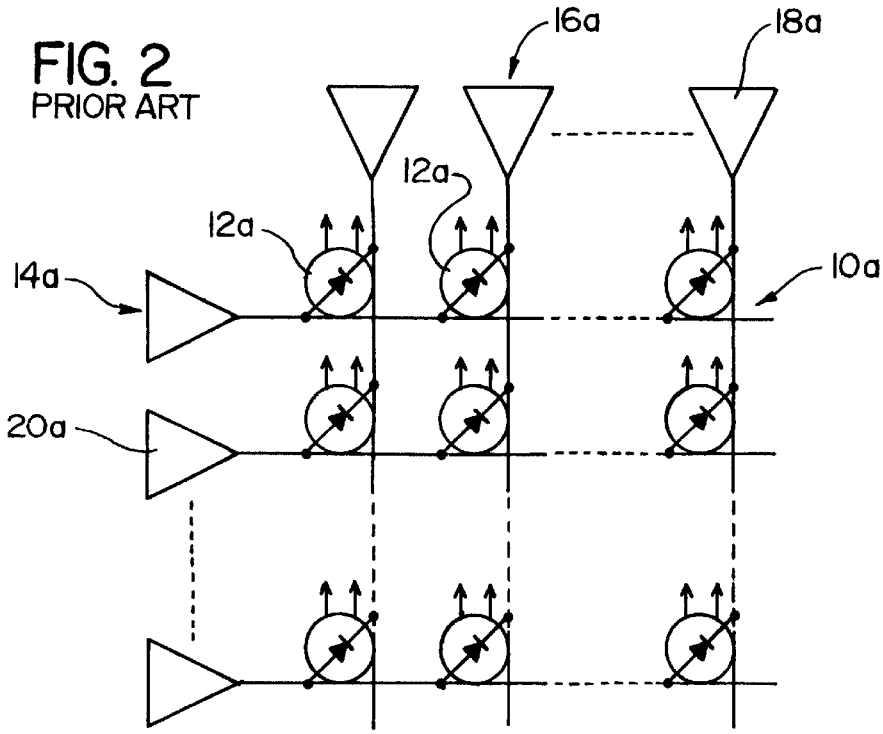
FIG. 2 PRIOR ART
FIG. 2 is a view similar to FIG. 1, showing schematically an arrangement of a matrix display system similar to that show in FIG. 1, but using light emitting diodes.

A second prior art method is shown in FIG. 2, where there is shown a multiple matrix display 10*a* where there is a plurality of light emitting dioxides 12*a* arranged in rows 14*a* and columns 16*a*, and also having column drivers 18*a* and row drivers 20*a*. The mode of operation is substantially the same as described with regard to the first prior art apparatus shown in FIG. 1.

FIGS. 3A, 3B, 3C and 3D show a third prior art matrix display system where there is a plurality of display elements 22, only one of which is shown. The display elements 22 are arranged in a plurality of columns and rows, in the manner described with respect to the systems of FIGS. 1 and 2.

Figure 3A:
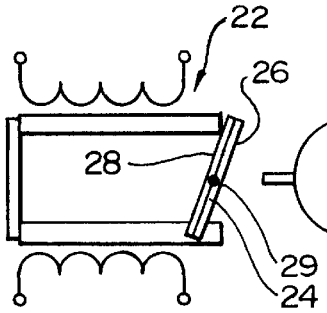
FIG. 3A PRIOR ART
FIGS. 3A, 3B, 3C and 3D are schematic drawings illustrating yet a third prior art display system, showing picture elements or pixels having a "flip disk" that can be rotated nearly 180° to present two different surfaces toward the viewing area.
Figure 3C:
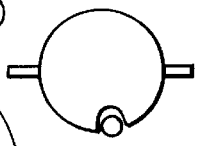
FIG. 3C PRIOR ART
Figure 3B:
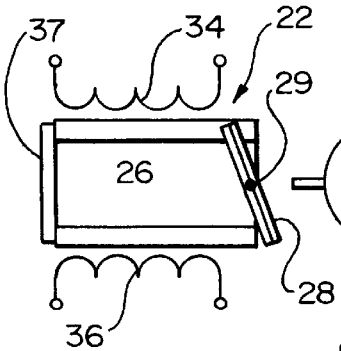
FIG. 3B PRIOR ART
Figure 3D:
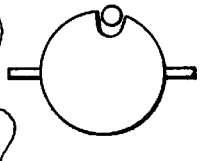
FIG. 3D PRIOR ART

Each display element 22 comprises a disk 24, one side 26 of which is reflective, with the other side 28 being non-reflective. There is a layer of a permanent magnetic material applied to the disk 24. The disk is pivotally mounted at 29, so that it can be rotated between a first reflective position (FIG. 3A) to a non-reflective position (FIG. 3B). In order to move the disk 23 between these two positions, there is provided an actuator 30, in the form of a reversible magnet 31, comprising a pair of arms 32. This actuator 30 also comprises two coils 34 and 36, each one electrically coupled to a respective one of the arms 32. The two coils 36 have a common pole shunt 37 between them. The momentary energization of the coils 34 and 36 (in the proper polarity) causes the disk 24 to pivot to one of the two positions, as shown in FIGS. 3A and 3B. The disk 24 will remain in that position after the removal of the coil current (due to the remnant magnetism in the coil poles, namely the arms 32).

(b) First Embodiment

Figure 4A:
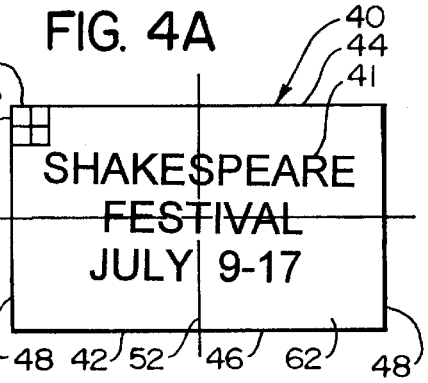
FIG. 4A is a simplified front view of a display sign made in accordance with the present invention, showing only four picture elements out of an entire array of such pixel elements.
Figure 4B:
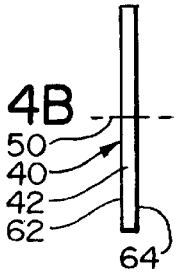
FIG. 4B is a side view thereof.

To describe now the system and method of the first embodiment of the present invention, reference is first made to FIGS. 4A and 4B where there is shown a matrix display sign 40 which is shown as displaying a selected message 41 comprising a plurality of letters and numbers. This sign 40 comprises a mounting structure or frame 42 which (in this preferred embodiment) has a generally rectangular configuration, having a top edge 44, bottom edge 46, and sides 48.

For purposes of description, the display sign 40 shall be considered as having a forward to rear axis 50, a vertical axis 52, and a horizontal axis 54. The sign 40 comprises a plurality of display elements or pixel units, four of which are indicated somewhat schematically at the upper left hand corner of the sign 40 in FIG. 4A. These pixel units are arranged in columns 58 and rows 60. The sign 40 has a front display area or surface 62 and a rear surface. Each pixel unit 56 can be selectively activated so that these collectively provide a display of a picture or message, such as shown as 41.

Figure 5A:
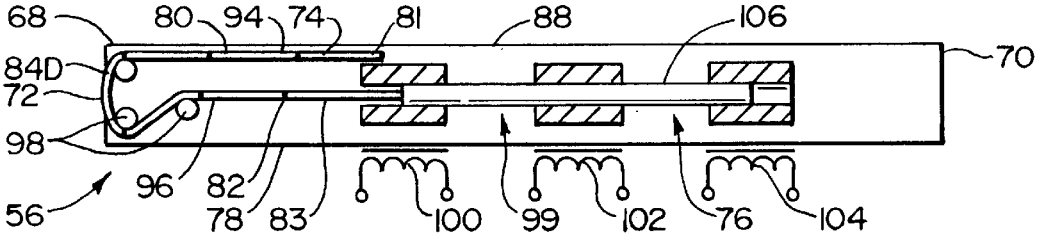
FIG. 5A is a longitudinal sectional view showing a first embodiment of a display element (or pixel unit) of the present invention.
Figure 5B:
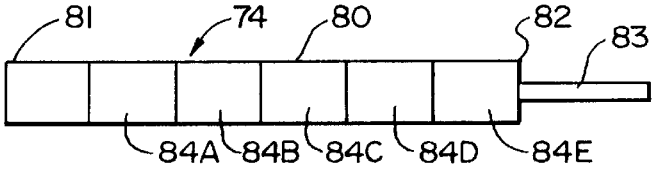
FIG. 5B is a plan view showing the pixel member, having five pixel sections, laid out flat, for purposes of illustration.
Figure 5C:
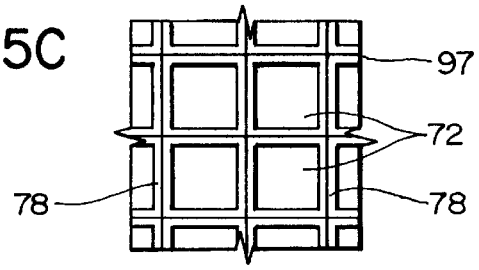
FIG. 5C is a frontal view of several adjacent display elements (i.e. pixel units)

To describe a first embodiment of the present invention, reference is now made to FIGS. 5A, 5B and 5C. In FIG. 5A, there is shown somewhat schematically a side elevational view of one pixel unit 56. This unit 56 has a front display end 68 and a rear end 70. At the front end 60, there is a forwardly facing display region 72. The display regions 72 of the pixel units 56 are located coincident with the plane at which the display area 62 is located.

The pixel unit 56 has the capability of displaying at the display region 72 any one of several pixel sections of different colors. In the embodiment described with reference to FIGS. 5A through 5C, in addition to presenting a white or black surface, there is a capability of providing a green, red or blue surface. As will become apparent from the following description, more or fewer color sections could be provided. The term "color" is to be interpreted in a broader sense to describe different visual effects. For example, the intensity of the light either transmitted from (or reflected from) the display region 72 of the pixel unit 56 could be varied and/or other visually perceptible characteristics at the display region.

In general, each pixel unit 56 comprises a color responsive pixel member 74, an actuating means 76, and a mounting structure 78 by which the components 74 and 76 are operably positioned and enabled to function in the manner to be described below.

With reference particularly to FIG. 5B, it can be seen that the pixel member 74 is in the form of an elongate, generally planar, and moderately flexible strip 80 having a first end 81 and a second end 82. There is a connecting tab 83 extending rearwardly from the second end 82.

The strip 80 comprises five pixel sections designated 84A–84E, positioned immediately adjacent to one another at spaced intervals along the length of the strip 80. Each of these pixel sections 84A–84E have length and width dimensions slightly greater than the display region 72, so that when any one of these sections is positioned at the display region 72, that particular section 84A–84E extends entirely across the display region 72. Frontal illumination can be directed toward the display area 62 to cause light to be reflected from the display regions of the pixel units 56.

The mounting structure 78 comprises a top wall 88 and a bottom wall 90. Further, there is a front window portion 92 at the display region 72 (See FIG. 9). As seen in FIG. 5A, the pixel section 84D is at the display region 72, so that the strip 80 is positioned to have a first portion 92 adjacent to the end 81 that is positioned adjacent to the top wall 88 and a second portion 96 that is positioned just forwardly of the actuator 76 and connecting to the connecting tab 83.

Picture 5C is a frontal view taken from the left of FIG. 5A and looking toward the display region 72. However, instead of showing only the single pixel member 56, there are shown completely the display region 72, four of the pixel members 56, and only portions of the display regions of adjacent pixel members. It can be seen that each display region 72 has at its perimeter portions of the front end of the mounting structure 78, these being shown at 97.

Further, there is suitable guide means, shown schematically as rollers 98, which properly positions the strip member 80 so that it is able to travel on a linear path along the upper path portion where the strip portion 94 is located in FIG. 5A, along the path portion adjacent to the display region 72, and also along the path portion, where the strip portion 96 is located in FIG. 5A, leading from the display region 72 to the connecting tab 83.

The actuator 76 comprises a solenoid actuator 99. This solenoid actuator 99 comprises three coil sections, namely a front coil section 100, and intermediate coil section 102 and a rear coil section 104. Extending through the three coil sections 100–104 is an armature 106 (or core 106) which is moved and positioned in accordance with the pattern of current flow through the coils 100–104. In this arrangement, the armature 106 can be selectively positioned in five different locations, so that a selected one of five display sections 84A–84E can be selectively positioned at the display location 72.

At this time, the operation of this actuating means 98 will be described briefly with reference to FIGS. 6A through 6E. Later in this text, the control circuitry to selectively energize the appropriate coils 100, 102, and 103 will be described.

In FIG. 5A, and also in FIGS. 6A–6E, the coils 100–104 and the armature 106 are shown somewhat schematically, and it is to be understood, of course, that the coil sections 100–104 extend circumferentially around the armature 106.

Figure 6A:
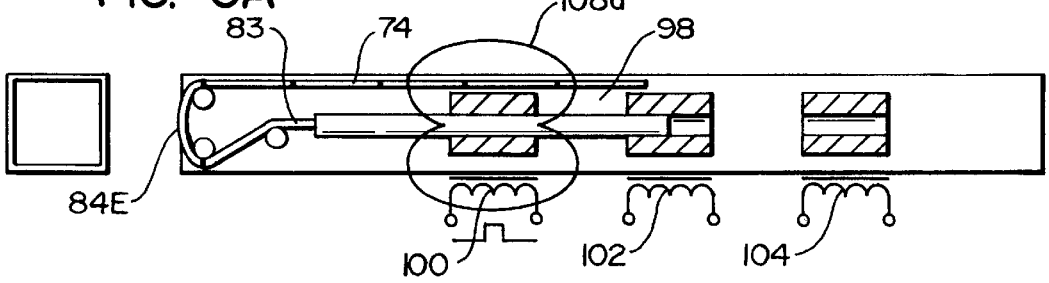
FIGS. 6A through 6E are five illustrations, similar to FIG. 5A, showing the pixel unit 5A in five different operating positions, each with a different display section at the display location.
Figure 6B:
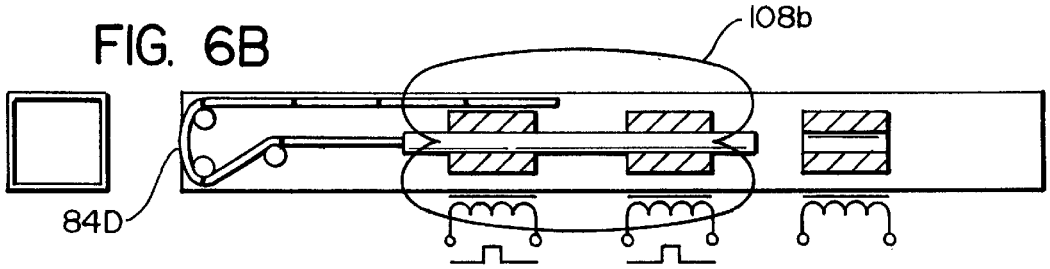

In FIG. 6A, there is a situation shown where only the front coil section 100 is activated, and the magnetic field created by this single coil section 100 is indicated schematically at 108*a*. It can be seen that the armature 106 centers itself in the magnetic field 108*a*. This is the most forward position of the armature 106, and thus (in this position), the red display section 84E of the strip 80 is positioned at the display region 72.

Figure 6C:
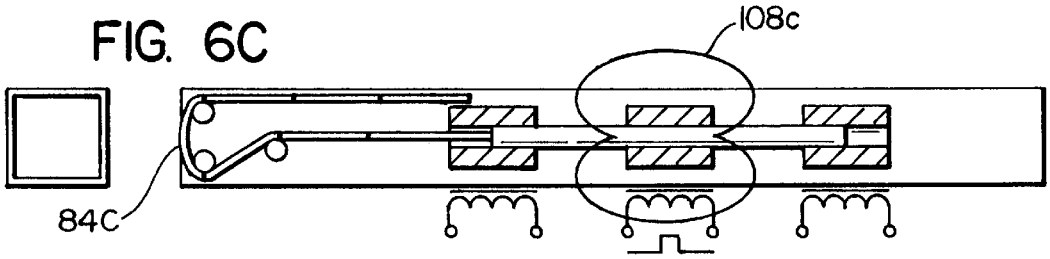

To position the armature 106 in its next adjacent operating position, the forward and middle armature coils 100 and 102 are activated so as to create the magnetic field indicated at 108*b*. It can be seen in FIG. 6B that the armature 106 is now centered relative to the coil sections 101 and 102, and thus the next adjacent display section 84D which displays the color green is positioned at the display region 72. With reference to FIG. 6C, only the middle coil 102 is energized, creating the magnetic field indicated schematically at 108*c*, with the armature 106 being centered relative to the magnetic field 108*c*. Thus, in this position of FIG. 6C, the display section 84C (displaying a blue color) is positioned at the display location 72.

Figure 6D:
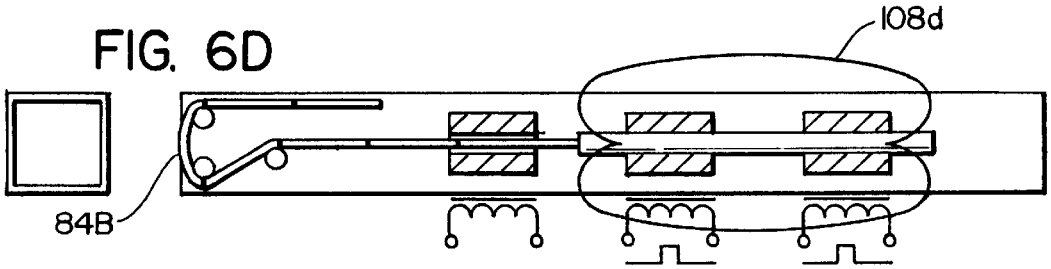
Figure 6E:
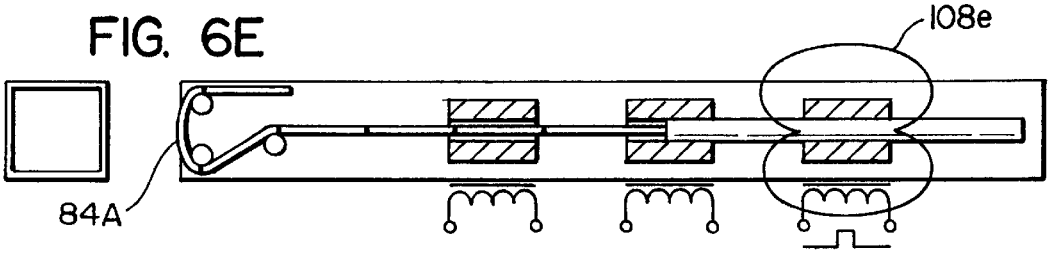

Following this same pattern, it can be seen that in FIG. 6D the middle and rear coil sections 102 and 104 are energized to create the magnetic field 108*d* so that the white display section 84B is at the display location 72. Then in FIG. 6E, with only the rear coil section 104 being activated, the armature 106 is at its furthest rear position so that the black display section 84E is displayed.

To review briefly the operation of this first embodiment, the pixel member 74 is located within the mounting means 78 so that the end 81 is positioned against the upper wall 88 and is directed rearwardly. From the end 81, the strip 82 extends forwardly adjacent to the upper wall 88, and then downwardly over the display region 72 and thence rearwardly toward the connecting tab 83, which in turn connects to the front end of the armature 106. There is the appropriate guide means 98 which functions in a manner that when the armature 106 is moved forwardly or rearwardly, the pixel strip portion 80 travels linearly in the same path so that selected display sections 84E—84E can be selectively positioned at the display region 72.

As indicated above, with reference to FIGS. 6A through 6E, the armature 106 can be moved to any one of five selected locations by the proper actuation of the appropriate coil or coils 101, 102 and 104. The armature 106 is able to move rather rapidly, and once in a selected position, the armature and the pixel member 74 will remain in that position until the solenoid actuator 76 is energized to change the position of the armature 106.

The movement of the armature is arranged so that the linear increments of travel of the armature 106 are equal to the length dimension of the pixel sections 84A–84E. Thus, as the armature moves between each of the five positions shown in FIGS. 6A–6E, the next adjacent pixel section 84A–84E moves into position at the display region 72.

Figure 7:
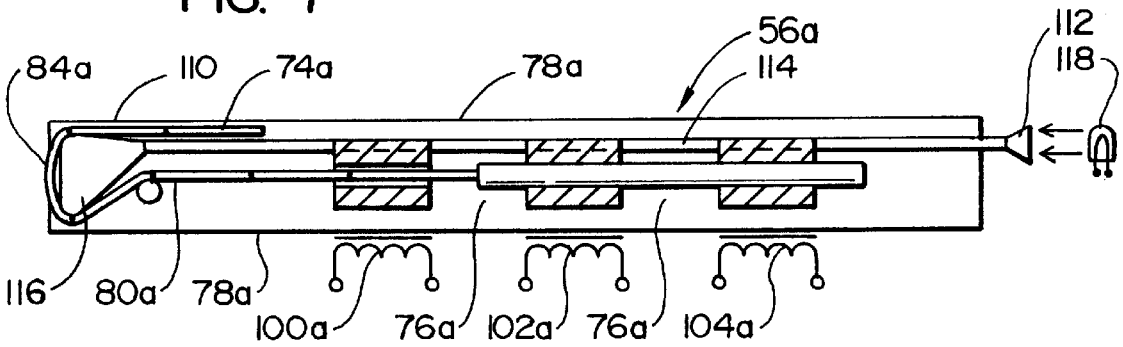
FIG. 7 is a view similar to FIG. 5, showing a second embodiment of the present invention, where a light tube is used to illuminate the pixel section at the rear surface, with the pixel section filtering out the unwanted light components and displaying the desired color.

A second embodiment of the present invention is shown in FIG. 7A. Components of this second embodiment which is similar to components of the first embodiment will be given like numerical designations, with a "a" suffix distinguishing those of the second embodiment.

There is shown one pixel unit 56*a*, having a pixel member 74*a*, an actuator 76*a*, and a mounting structure 78*a*, substantially the same as shown in FIG. 5A. However, the pixel member 74*a* is transflective and functions as a filter to transmit only light of a certain wave length. There is further provided a light tube 110 having a rear end 112, an elongate tube portion 114, and a transmitting end 116. A light source is provided at 118 to direct the light through the tube 114 to the transmitting end 116. The pixel section 84*a* (one of five selected pixel sections) is positioned to permit a light of a selected color to pass through. Of course, if the pixel section 84*a* is black no light is transmitted, and if it is white, all of the light is transmitted.

Figure 8A:
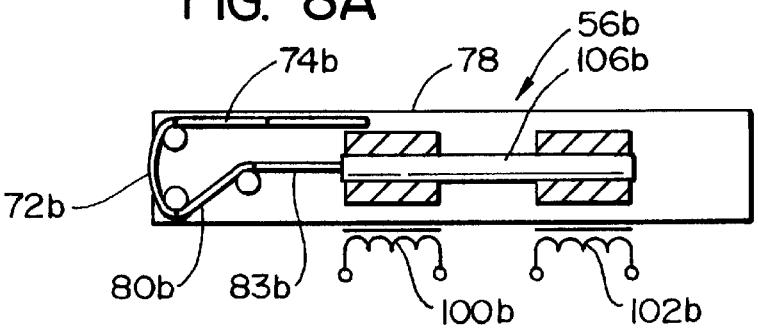
FIG. 8A is a sectional view of a third embodiment similar to the first embodiment of FIG. 5A, showing an arrangement where there are only two coil members in the solenoid actuator.
Figure 8B:
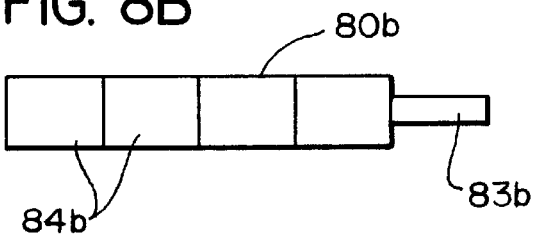
FIG. 8B is a "laid flat" view of the pixel member of this third embodiment.

FIG. 8A shows a third embodiment showing a different pixel unit 56*b*. This is substantially the same as the first embodiment, except that there are only two coil sections 100*b* and 102*b* which function in substantially the same manner as the two corresponding coil sections of the first embodiment. Since these coil elements 100*b* and 102*b* move the armature 106*b* to only three different locations, there are three different pixel sections designated generally 84*b* (it being understood that these would have differing color characteristics). The operation of this third embodiment of FIGS. 8A and 8B are substantially similar to the operation as described with reference to the first embodiment.

Figure 9:
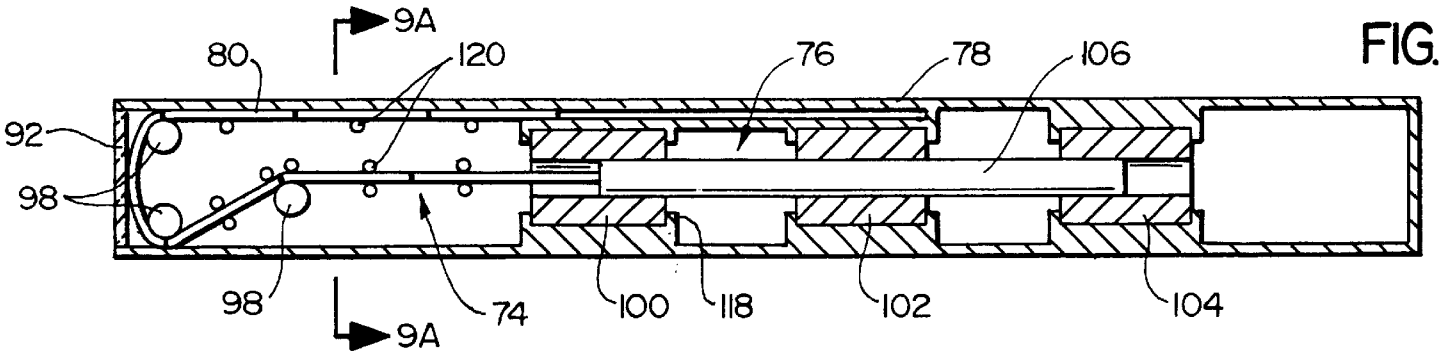
FIG. 9 is a view, substantially the same as FIG. 5A, of the first embodiment, but showing the first embodiment with additional mounting structure.
Figure 9A:
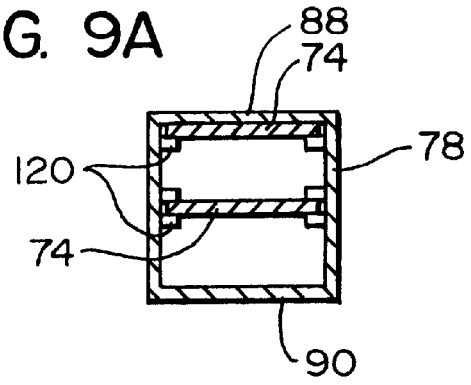
FIG. 9A is a sectional view taken along line 9A—9A of FIG. 9.

FIGS. 9 and 9A show the first embodiment of the present invention (also displayed in FIGS. 5A–5C), but with additional structure. More specifically, the coil members 100, 102 and 104 are shown surrounding the armature 106, and these are shown positioned by suitable mounting structure indicated generally at 118.

Further, the guide members 98 are shown (which are shown schematically in FIG. 5A only as three rollers are now supplemented by a plurality of pin members 120 which are positioned at spaced intervals to insure that the pixel strip 80 is constrained to move along its linear path of travel.

Figure 10:
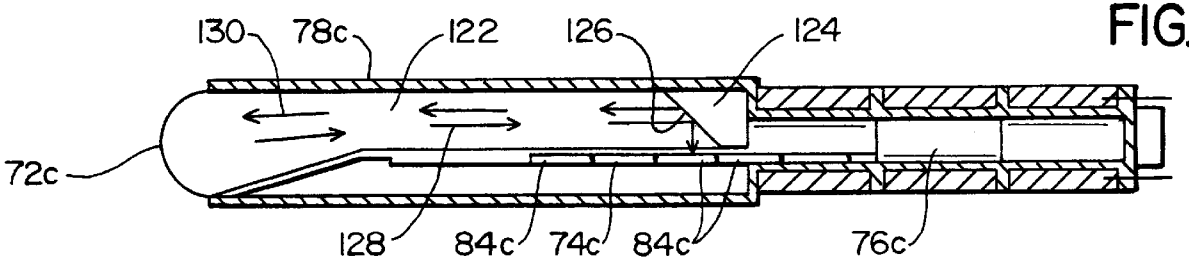
FIG. 10 is a sectional view similar to FIG. 5A, showing a fourth embodiment of the present invention.

FIG. 10 shows a fourth embodiment of the present invention. Components of this fourth embodiment which are similar to components of the prior embodiments will be given like numerical designations, with a "c" suffix distinguishing those of this fourth embodiment. There is shown a reflective pixel member 74*c* having a plurality of pixel sections, each of which is designated 84*c*. In addition, there is a solenoid actuator, generally designated 76*c*. Light from an exterior source is directed toward the frontal area 72*c* and travels rearwardly through a longitudinal passageway 122 positioned within the mounting structure 78*c*. At the rear of the passageway 122 there is a reflector 124 having a reflecting surface 126 slanted at a 45° angle to the lengthwise axis. It can be seen that as the light travels inwardly, as indicated by the arrows 128, the light strikes the reflective surface 126 to be reflected against one of the pixel sections 84*c*. The light is reflected back upwardly to the surface 126 and then forwardly as indicated by the arrows at 130. By moving the pixel member 74*c* to the appropriate location, the proper color can be transmitted to the display region 72.

Figure 12:
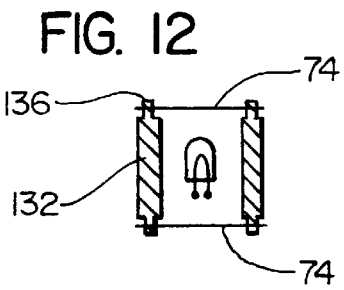
FIG. 12 is a sectional view taken along line 12—12 of FIG. 11.
Figure 11:
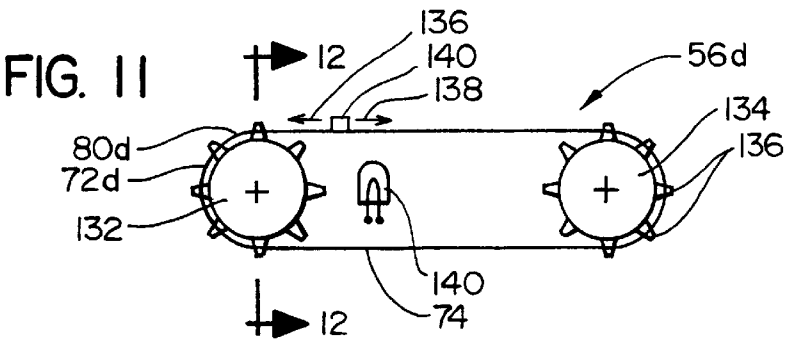
FIG. 11 is a view showing a portion of a fifth embodiment, where the pixel member is mounted to front and rear sprockets.

FIGS. 11 and 12 disclose a fifth embodiment, showing only the pixel member 74*d* of a pixel unit 56*d*. The flexible pixel member 74*d* has a pixel strip 80*d* which is arranged so that it travels around a forward and a rear set of laterally spaced sprockets, designated 132 and 134, respectively. The lateral edges of the pixel strip 80*d* have spaced openings and engage the teeth 136 of the sprocket members 132 and 134. A solenoid actuator can be used to cause the linear movement of the pixel member 74, and this is shown schematically by the arrows 138 and 136 acting against a contact member 140 attached to the pixel strip 80. A light 142 can be provided to transmit light through a frontal area 72*d*. The operation is substantially the same as described previously herein.

Figure 13:
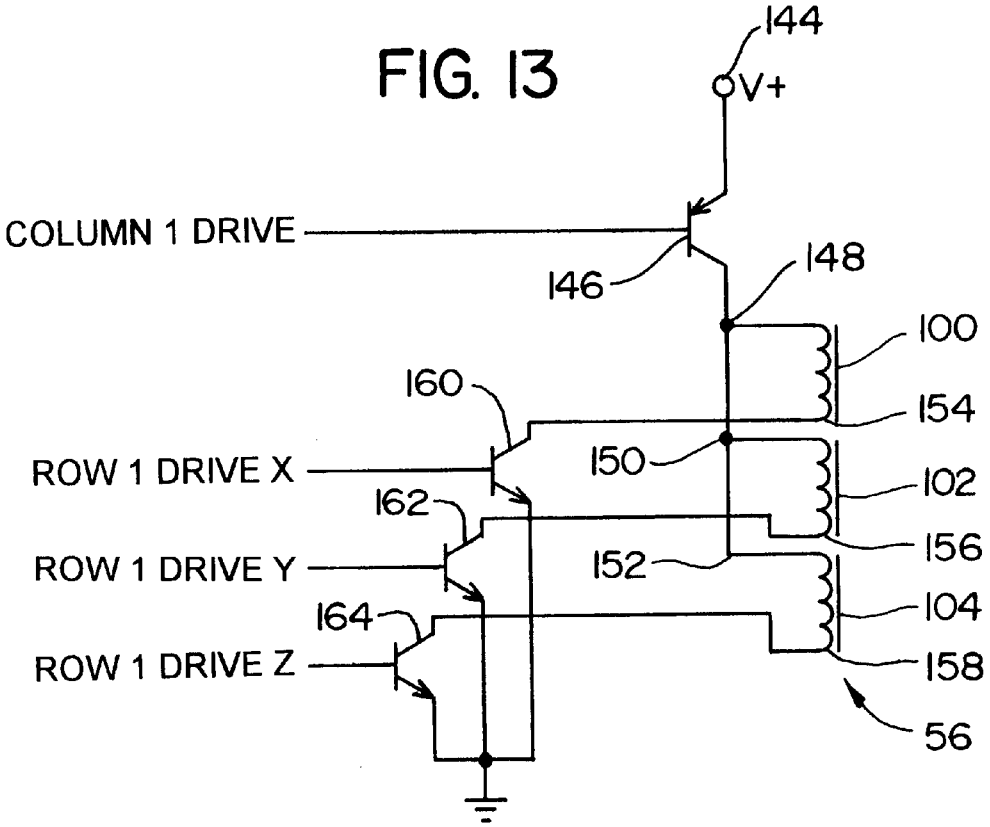
FIG. 13 is a diagram of a portion of the control circuitry by which the various display units (pixel units) are activated.

FIG. 13 shows somewhat schematically a portion of the circuitry to activate the various pixel units. As shown in FIG. 4, there is a plurality of columns of 58 of pixel units 56. For each column, there is a power input terminal 144 (See FIG. 13). For each column 144 there is a column driver (See FIG. 14) which acts through a switch (transistor) 146 (See FIG. 13) to transmit current to coil connections 148, 150, and 152 at the upper end of its respective coil 100, 102 and 104. The opposite ends 154, 156 and 158 of each coil 100, 102 and 104 connect through a respective transistor 160, 162 and 164 to a related set of row drives, indicated in FIG. 13 as row drive x, y and z.

To describe the operation of this circuitry, let it be assumed that one or more of the pixel units 56 in a single column is to be activated. The computer unit acts through the column drivers to scan the columns 58 and sequentially turn on the transistors 146 of these columns, to cause the power input terminal 144 to be able to transmit power to each of the pixel units 56 in that column. For any particular pixel unit 56 in that column to be activated, one or more of the transistors 160, 162, and 164 is activated (in timed sequence with the activation of the transistor 146) to direct current through the selected coil or coils 100, 102, and 104.

Let it be assumed, for example, that only the coil 100 is to be activated so as to place the armature 106 in the position of FIG. 6A. Then only the transistor 160 is turned on to cause current to flow only through the coil 100. In a similar manner, any one of the coils 100, 102, and 104 can be activated.

Figure 14:
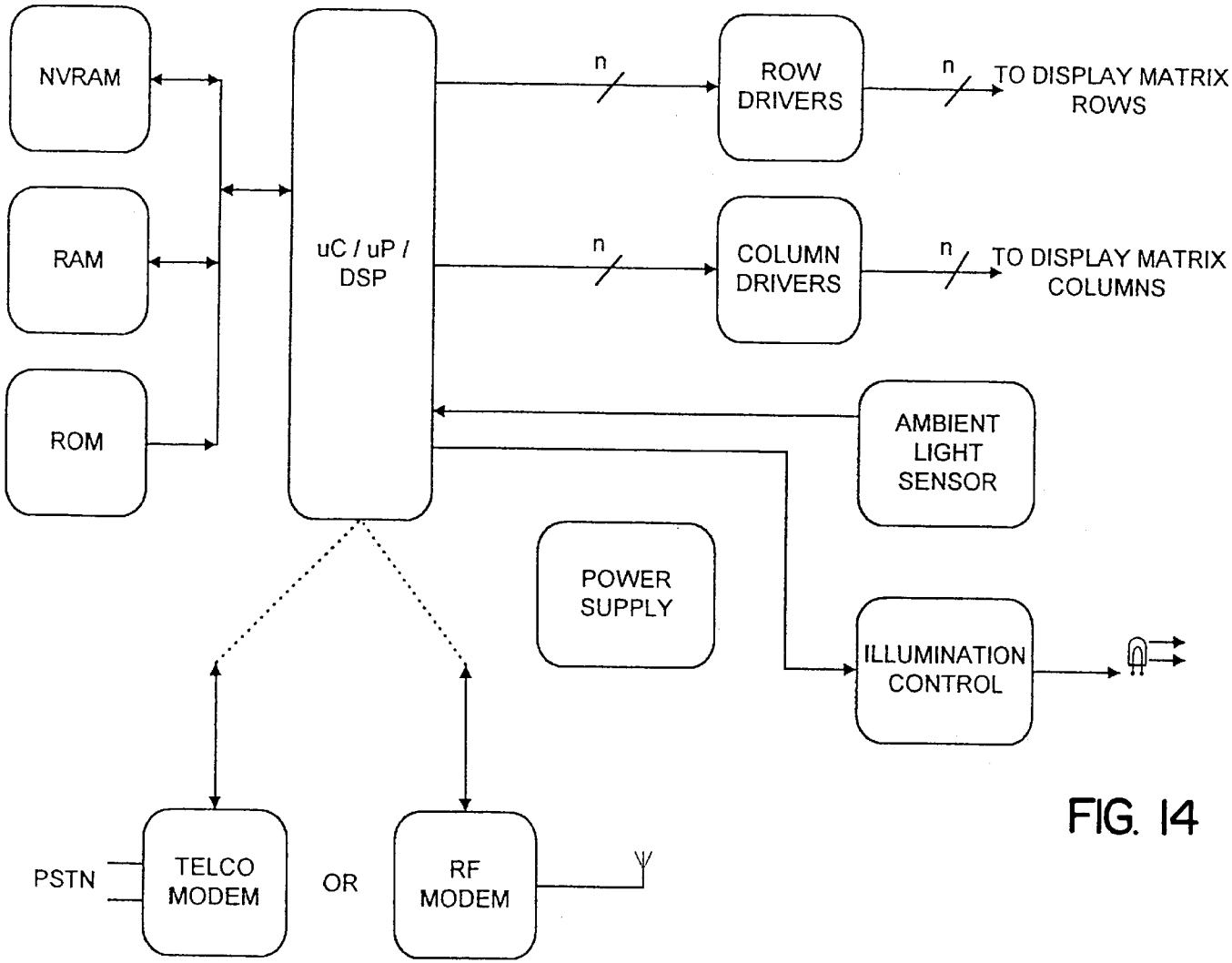
FIG. 14 is a schematic drawing of the control and interface system of the present invention.

FIG. 14 shows the overall control and interface system of the present invention. There is a micro-controller or microprocessor (designated "uC/uP/dps" having the speed and processing capability required for this particular application. Also shown are the read only memory (ROM) for stored program retention, the random access memory (RAM) for operational data storage and retrieval, and the non-volatile random access memory (NVAM) for the storage of bias and control data. There are the row and column drivers to perform the function described previously with regard to FIG. 13 to cause the various pixel units to operate as desired. This is accomplished in a standard multiplex fashion under the control of the processor. There is provided an ambient light sensor to sense the ambient light levels and control ancillary illumination (front if reflective or rear if transflective).

With regard to the power supply and communication components, communications can be effected via a wireless RF modem (narrowband or broadband, spread spectrum, etc.) or via the public switched telephone network (PSTN). These communications can be uni- or bi-directional in order to allow for the remote downloading and updating of graphical display data and/or remote diagnostics. It is well within the skill of the art to implement this control and interface system, so no detailed description of the same will be given herein.

Figure 15:
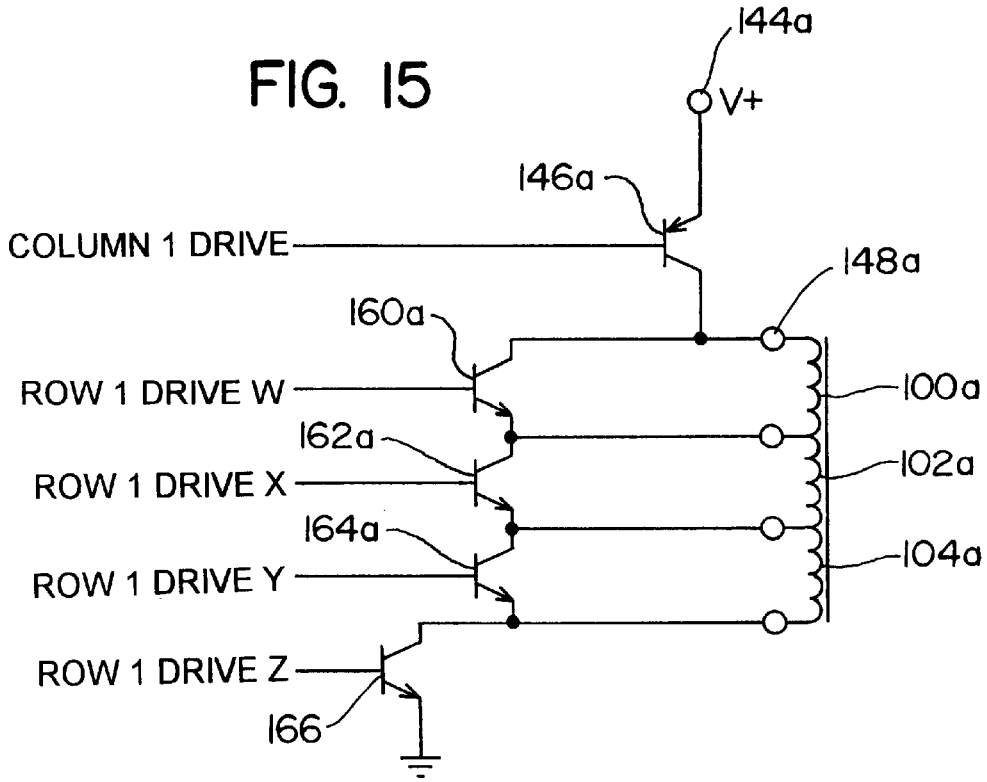
FIG. 15 is a schematic drawing of an alternative form of the control circuitry of the present invention.

FIG. 15 shows an alternative arrangement of the circuitry shown in FIG. 13. As in FIG. 13, there is the power terminal 144*a*, and also the transistors 146*a*, 160*a*, 162*a*, and 164*a*. In addition, there is provided an additional transistor 166. The coil sections 100*a*, 102*a* and 104*a* are connected to each other in series, and also the transistors 106*a*, 162*a*, and 164*a* are also connected together in series.

The transistor 176 is connected to the one terminal of the transistor 160*a* and also to a connecting location 148*a* that in turn connects to the upper end of the coil section 100*a*. By activating the required transistor or transistors 160*a*, 162*a* and 164*a*, the coil or coils in combination 100*a*, 102*a* and 104*a* can be energized in the manner described previously with regard to FIG. 13.

Both the lower connection of the coil and the lower connection from the transistor 164*a* are connected through the transistor 166 to ground.

It is obvious that various modifications could be made without departing from the basic teachings of the present invention.

What is claimed is:

1. A matrix display apparatus comprising:

a. a mounting structure providing a front display area;

b. a plurality of display elements positioned at respective spaced locations across said display area, each of said display elements having a display region at a respective display location in said display area;

c. each of said display elements comprising a color responsive pixel member having a set of color responsive pixel sections, each of which has a color character differing from the color character of other color responsive pixel sections of said set;

d. actuating apparatus to selectively move the pixel members to position selected ones of said pixel sections at operative locations in their display elements to provide pixel images at the display regions where a multi-color image can be displayed by displaying various pixel images of different color character in an appropriate pattern corresponding to the image to be displayed;

e. said color responsive pixel members each comprising a pixel strip with said pixel sections being positioned at spaced locations along said strip, and said actuating apparatus moves said pixel strip through increments of travel to position selected ones of said pixel sections at the display area.

2. The apparatus as recited in claim 1, wherein said pixel sections are reflective and light traveling toward said display area is reflected from said pixel sections at their respective operating locations.

3. The apparatus as recited in claim 1, wherein said pixel sections are arranged to permit light to pass therethrough, and light is directed toward said pixel sections at the display regions from a location behind said display area.

4. The apparatus as recited in claim 1, wherein each display element has a front to rear axis having a substantial alignment component perpendicular to said display area, said pixel strip being positioned to travel a linear path of travel forward to said display region, over said display region, and then rearwardly from said display region, whereby said pixel member, moving along said linear path of travel, is able to have selected pixel sections positioned at said display region.

5. The apparatus as recited in claim 4, wherein said pixel strip is sufficiently flexible to travel along said travel path, but sufficiently stiff so that said pixel strip can be either pushed or pulled to be moved along said travel path.

6. The apparatus as recited in claim 1, wherein said actuating apparatus comprises a plurality of actuators, with each of the display elements having a respective one of said actuators, each of said actuators being arranged to be able to be moved through increments of travel corresponding to spacing of said pixel sections, whereby each of said actuators in moving sequentially to various actuating positions is able to move said pixel strip to an appropriate location to display a selected one of said pixel sections at the display region.

7. The apparatus as recited in claim 6, where each of said actuators comprises a solenoid actuator, having an armature, and said armature is arranged to be moved linearly to selected locations.

8. The apparatus as recited in claim 7, wherein each of said solenoid actuators has a plurality of coil sections spaced from one another, and selected coil sections are able to be activated to create magnetic fields to position said solenoid at selected locations.

9. The apparatus as recited in claim 8, wherein said display elements are arranged in columns and rows, said apparatus further comprising a control system comprising a plurality of column drivers, each operatively connected to a respective column, and a plurality of row drivers, each operatively connected to a respective row, said control means having the capability of activating selected ones of said column drivers and row drivers, in a manner that display elements aligned with any pair of an activated column driver and an activated row driver is activated.

10. The apparatus as recited in claim 9, wherein at least one of the row driver or said column driver has a plurality of switches operatively connected to related coil sections so as to selectively activate one or more of the coil sections of that related display element, to position a selected pixel segment at said display area.

11. A method of providing a display apparatus comprising:

a. providing a display apparatus comprising:
   i. mounting structure providing a front display area;
   ii. a plurality of display elements positioned at respective spaced locations across said display area, each of said display elements having a display region at a respective display location in said display area;
   iii. each of said display elements comprising a color responsive pixel member having a set of color responsive pixel sections, each of which has a color character differing from the color character of other color responsive pixel sections of said set;

b. selectively moving the pixel members to position selected ones of said pixel sections at operative locations in their display elements to provide pixel images at their respective display regions where a multi-color image can be displayed by displaying various pixel sections of different color character in an appropriate pattern corresponding to the image to be displayed;

c. said method further comprising positioning said color responsive pixel member on a pixel strip with said pixel sections being positioned at spaced locations along said strip, said method further comprising moving said pixel strip through increments of travel to position selected ones of said pixel elements at the display area.

12. The method as recited in claim 11, further comprising reflecting light traveling to said display area from said pixel sections at their respective operating locations.

13. The method as recited in claim 11 further comprising directing light toward said pixel sections at the display regions from a location behind said display area and causing the light to pass through the pixel sections at their display region.

14. The method as recited in claim 11, wherein each display element has a front to rear axis having a substantial alignment component perpendicular to said display area, said method further comprising moving said pixel strip along a linear path of travel forward to said display region, over said display region, and then rearwardly from said display region, to position selected pixel sections at said display region.

15. The method as recited in claim 14, wherein there is a plurality of actuators, with each of the display elements having a respective one of said actuators, said method further comprising moving each of said actuators through increments of travel corresponding to spacing of said pixel sections, whereby each of said actuators in moving to various actuating positions is able to move said pixel strip to an appropriate location to display a selected one of said pixel sections at the display region.

16. The method as recited in claim 15, where each of said actuators is a solenoid actuator, having an armature, said method comprising moving said armature linearly to selected locations.

* * * * *